United States Patent [19]

Burke et al.

[11] Patent Number: 4,859,142

[45] Date of Patent: Aug. 22, 1989

[54] TURBINE CLEARANCE CONTROL DUCT ARRANGEMENT

[75] Inventors: William F. Burke, Marlborough; Daniel E. Kane, Tolland, both of Conn.

[73] Assignee: United Technologies Corporation, Hartford, Conn.

[21] Appl. No.: 150,866

[22] Filed: Feb. 1, 1988

[51] Int. Cl.[4] ..... F02C 25/12

[52] U.S. Cl. ..... 415/116; 415/178

[58] Field of Search ..... 415/115, 116, 117, 178; 60/226.1, 266, 39.75, 39.83

[56] References Cited

U.S. PATENT DOCUMENTS

| | | | |
|---|---|---|---|
| 3,034,298 | 5/1962 | White | 415/116 |
| 4,069,662 | 1/1978 | Redinger et al. | 60/226.1 |
| 4,279,123 | 7/1981 | Griffin et al. | 60/266 |
| 4,485,620 | 12/1984 | Koenig et al. | 415/116 |
| 4,553,901 | 11/1985 | Laurello | 415/178 |

*Primary Examiner*—Louis J. Casaregola

*Attorney, Agent, or Firm*—Kochey, Jr. Edward L.

[57] ABSTRACT

The cooling air duct for a clearance control system has spacers which abut the surface to be cooled. Critical spacing for proper cooling is obtained and is easily inspected. Ajustable supports facilitate adjustment.

3 Claims, 2 Drawing Sheets

TURBINE CLEARANCE CONTROL DUCT ARRANGEMENT

DESCRIPTION

1. Technical Field

The invention relates to gas turbine engine clearance control and in particular to an arrangement for supporting the cooling air ducts therefore.

2. Background of the Invention

U.S. Pat. No. 4,069,662 discloses a clearance control system for a gas turbine engine. Cooling air is ducted around the periphery of the gas turbine casing and impinged on the surface. This local cooling shrinks the casing in sufficient amount to avoid excessive clearances between the turbine blades and the casing. It is selectively modulated as a function of engine operating condition to provide appropriate clearance for each condition.

These ducts surround the casing in the area of the flanges and contain holes of selected size and location to direct air against the flange and adjacent casing. In the interest of minimizing the required air flow, selection of the hole size with respect to the design distance between the duct and casing is carefully selected. Variation of the actual spacing from the design has substantial effect on the cooling and therefore the effectiveness of the clearance control. For instance, an increase of the spacing from 0.200 inches to 0.240 inches reduces the cooling effectiveness 10 percent.

With the ducts in place, the space between the duct and casing is not easily accessible. During installation it is difficult to measure the clearance, difficult to obtain the clearance while relocating the ducts, and difficult to inspect the installation to determine if proper clearance has been set. Such difficulty is experienced under maintenance conditions, as well as during initial fabrication. The problem is exacerbated by the possible lack of appreciation by maintenance workers for the criticality of such an apparently simple construction.

SUMMARY OF THE INVENTION

The cooling air ducts of a clearance control system are supplied with attached spacers of preselected lengths which abut the turbine casing and flange or bolt surfaces. Adjustable supports permit duct installation with the spacers in contact with the surfaces. Installation of duct with proper spacing is simplified, inspection to determine the proper spacing is facilitated. Rubbing of the duct against components which would wear holes in the duct is also avoided.

DESCRIPTION OF THE PREFERRED EMBODIMENT

Figure 1:
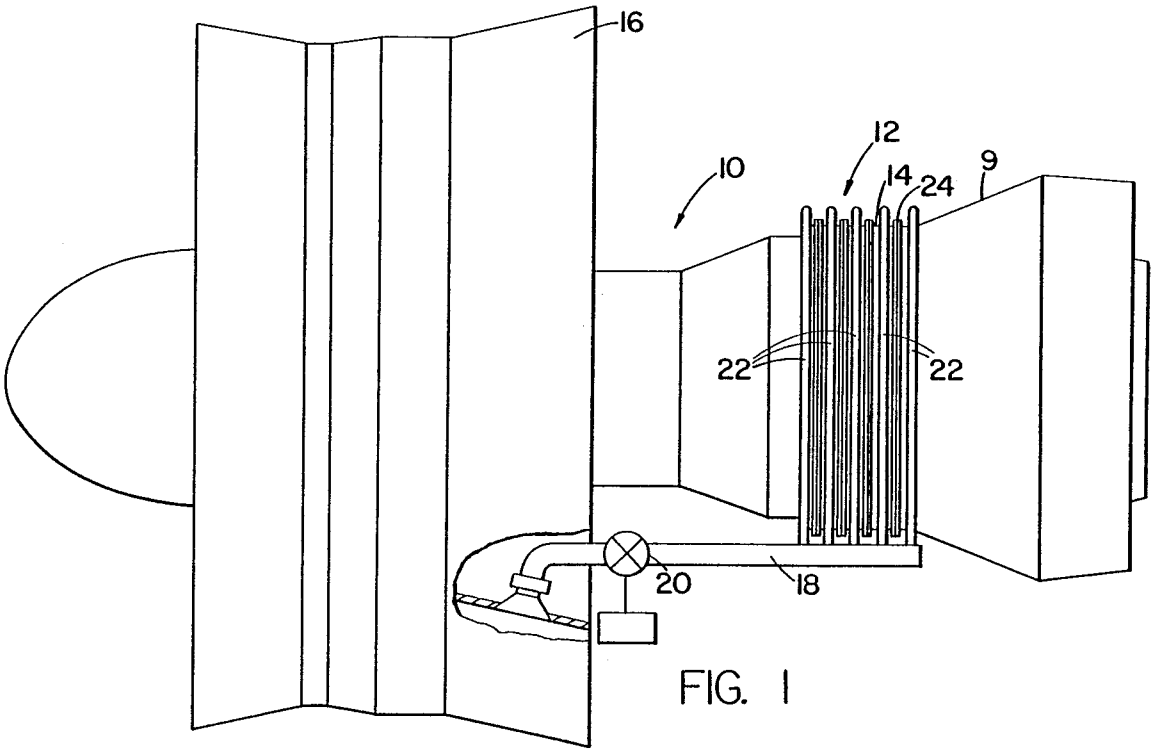
FIG. 1 is a view of a gas turbine engine showing the arrangement of cooling air ducts.

Gas turbine engine 10 includes a gas turbine section 12 having gas turbine casing 14. A bypass duct 16 contains air under pressure, a portion of which passes through manifold 18 under control of valve 20.

Figure 2:
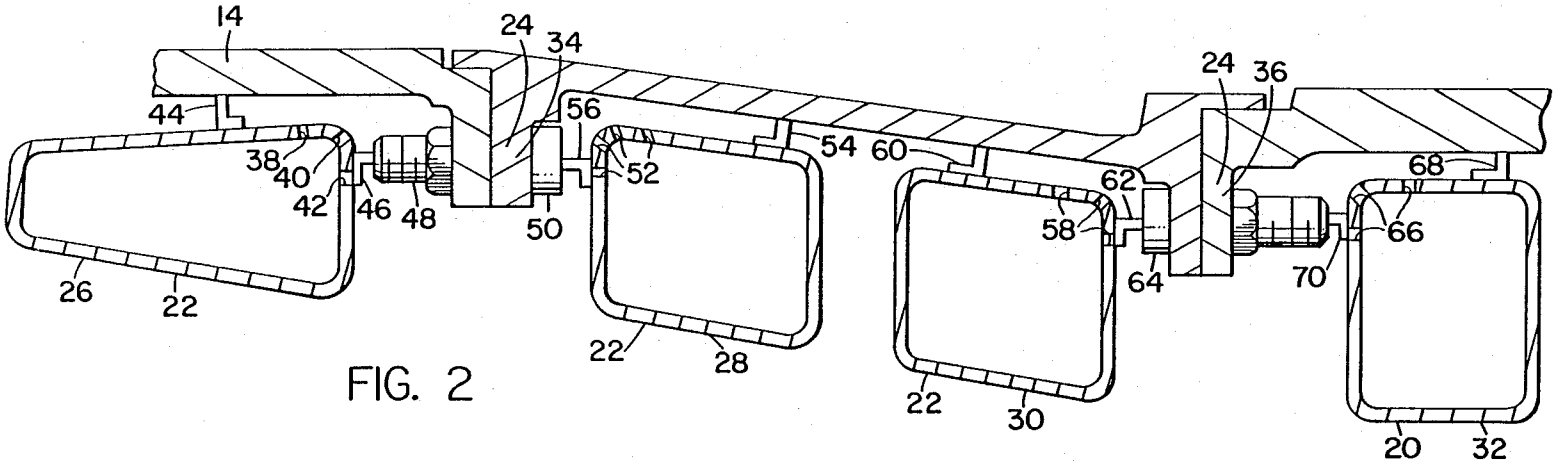
FIG. 2 is a section through the ducts showing the spacing from the casing.

This manifold 18 supplies a plurality of cooling air ducts 22 each of which is a 180 degree segment surrounding turbine casing 14 adjacent to flanges 24. Referring to FIG. 2, four ducts 22 are shown designated 26, 28, 30 and 32, respectively. Similarly, two flanges 24 are shown designated 34 and 36, respectively.

Duct 26 has a plurality of openings 38, 40 and 42 therein for directing cooling air against the surface of casing 14 and flange 34. These are selected in appropriate number and of appropriate size to achieve optimum cooling of the surfaces. A plurality of radial spacers 44 are located on the duct extending 0.2 inches from the duct surface and located to abut surface 14. A plurality of axial spacers 46 abut the end of the threaded portion 48 of bolt 50. These extend 0.1 inches providing a clearance from the flange surface of 0.3 inches. The flange 34 and bolts 50 form a flange structure, and the spacers 46 may be designed to abut either the bolt or the flange.

Openings 40 and 42 are larger than openings 38 since they have to project further to the surface to be cooled. Once the design has been established the spacing between the openings and the surface to be cooled is critical. Should the distance become too great the energy is dissipated before it contacts the surface, while on the other hand should the selected opening become too close, the cooling becomes too local without the jet spreading over the desired area.

In a similar manner duct 28 has a plurality of openings 52 with spacer 54 providing a clearance of 0.2 inches from casing 14 while spacer 56 establishes a clearance of 0.2 inches from the head of bolt 60.

Duct 30 has a plurality of openings 58 with spacer 60 establishing a distance of 0.2 inches from the casing and spacer 62 establishing a distance of 0.19 inches from the head of bolt 64.

Duct 32 has a plurality of holes 66 with a radial spacer 68 establishing a distance of 0.2 inches from the casing and spacer 70 establishing a distance of 0.1 inches from the end of bolt 64.

Figure 3:
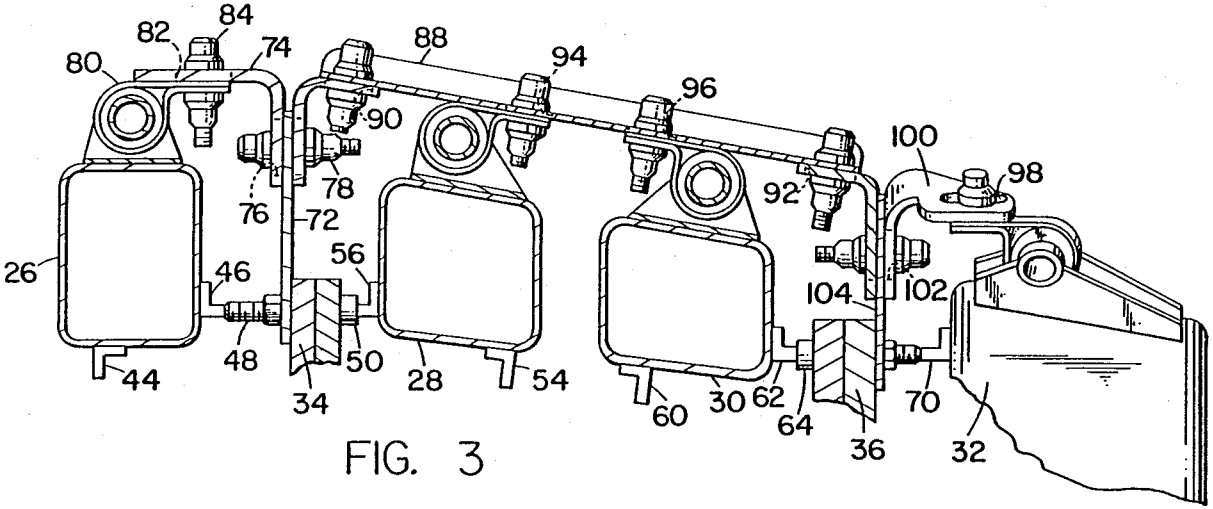
FIG. 3 is a section showing the support of the ducts.

Referring to FIG. 3 a bracket 72 is supported from flange 34 on the threaded side 48 of bolt 50. Support bracket 74 has a slotted opening 76 therein and is bolted by means of bolt 78 to bracket 72. Support bracket 80 is supported in a slotted opening 82 by bolt 84 with bracket 80 in turn supporting duct 26. During installation or maintenance work the duct spacing may be adjusted by the slotted openings until spacers 44 and 46 are in contact with the casing surface and the bolt end of the flange, respectively.

Support bracket 88 is supported through slotted openings 90 and 92, respectively, with duct 28 being supported through a slotted opening 94 and duct 30 being supported through a slotted opening 96.

In a similar manner duct 32 is supported from a slotted opening 98 in bracket 100 which in turn is supported through a slotted opening 102 to bracket 104.

We claim:

1. A clearance control cooling air duct arrangement for a gas turbine comprising:

a turbine casing;

a plurality of circumferential flange structures joining sections of said turbine casing;

a plurality of cooling air ducts circumferentially surrounding said casing adjacent to said flange structures;

supply means for supplying cooling air to said ducts;

multiplicity of holes in each of said ducts directing impingement cooling air against a flange and against the casing adjacent to the flange;

a plurality of radial spacer members secured to each duct extending radially toward said casing;

a plurality of axial spacer members secured to each duct extending axially toward a flange;

a plurality of support brackets secured to each flange; and support means for adjustably securing said ducts to said brackets, with said spacer members in contact with said casing and one of said flange structures.

2. An arrangement as in claim 1:

said flange structures each including a plurality of bolts, extending through the flanges having a head side and an axially extending threaded side; and said plurality of axial spacer members located on the threaded bolt side of the flange in contact with each flange structure being of sufficient length to maintain said duct free of said bolts.

3. An arrangement as in claim 2:

said brackets secured to the extending threaded side of said bolts extending through the flanges.

* * * * *